United States Patent [19]

Beyer et al.

[11] 4,350,142

[45] Sep. 21, 1982

[54] FIREPLACE DAMPER INDICATOR

[76] Inventors: Charles L. Beyer, 745 Woodlake Dr., Sacramento, Calif. 95815; Billy E. Fox, 5620 Dewey Dr., Fair Oaks, Calif. 95628

[21] Appl. No.: 222,633

[22] Filed: Jan. 5, 1981

[51] Int. Cl.[3] ..... F23L 3/00; G09F 19/02

[52] U.S. Cl. ..... 126/288; 74/96; 126/295; 116/307; 40/601

[58] Field of Search ..... 116/307; 126/295, 288; 40/617

[56] References Cited

U.S. PATENT DOCUMENTS

| | | | |
|---|---|---|---|
| 67,415 | 8/1867 | Cox et al. | 126/295 X |
| 387,091 | 7/1888 | Mahedy | 126/295 |
| 389,424 | 9/1888 | Vance | 126/288 |
| 2,100,732 | 11/1937 | Cage | 126/288 |
| 2,275,493 | 3/1942 | Benjamin | 126/288 |
| 2,350,441 | 6/1944 | Anderson | 126/295 X |
| 2,854,967 | 10/1958 | Robinson | 126/288 |
| 3,708,897 | 1/1973 | Adams et al. | 116/204 |

*Primary Examiner*—Daniel M. Yasich

*Attorney, Agent, or Firm*—Blair, Brown & Kreten

[57] ABSTRACT

Disclosed herein is an indicator system and linkage for a fireplace damper whereby the open and closed modes of a fireplace damper are readily indicated without the necessity of inspecting the damper itself. The apparatus includes a series of links which alternatively expose a pair of indicators which reveal the mode that the damper door is currently in.

2 Claims, 8 Drawing Figures

FIREPLACE DAMPER INDICATOR

BACKGROUND OF THE INVENTION

1. Field of the Invention

Prior art devices relating to dampers for fireplaces include a damper plate which is caused to overlie the damper door of a chimney flue and a bar associated therewith which causes the damper to move from an open to a closed position. However, in embodiments where the actuator arm extends downwardly into the fireplace area it is not known with any degree of surety whether the depending arm indicates an open or closed position. Therefore, the only reliable way to ascertain the mode of operation of the damper door is to inspect the damper door by looking up the chimney. This creates a needless hardship and further is prone to causing errors in judgement whereby it is believed that the damper is open when in fact it is closed. Fires which are started in the fireplace having a closed damper pose a serious hazard to the occupants of the building having this fireplace since smoke which would normally be routed up the chimney is diverted into the room causing smoke inhalation, smoke damage to articles which encounter this smoke, and a fire hazard since to rectify this closed damper situation one must expose oneself to the fire to actuate the damper arm.

Generally, a modern building has other means of being heated than just a fireplace. Therefore, when not in use, the fireplace damper should be closed to prevent the heat from the other source from escaping up the fireplace chimney. With the serious energy shortage, it is a prime concern to conserve energy in any form such as natural gas, oil, etc. Naturally, the damper must be opened while the fireplace is in use, but when it is not in use the damper should always be kept closed to conserve energy in summer as well as winter because even in summer when air conditioners are used, if the damper is open cool air escapes up the chimney, therefore wasting valuable energy even through electricity or whatever power is used to operate the air conditioner. These devices make it much easier to tell if it is "open".

SUMMARY OF THE INVENTION

Accordingly detailed herein is a means by which the mode of the damper door can accurately be determined with a minimum of inconvenience thereby eliminating errors in judgement which would cause the fire to be lit when the damper is closed. This is made possible by a linkage train which alternatively in one mode provides an indicator surface with the reading "open" when the damper door is in the open position and alternatively "closed+ when the damper is in the closed position.

The primary object of this invention therefore is to provide a linkage associated with the damper door of a fireplace that gives a positive indication of the damper mode.

A further object contempates providing a linkage which is reliable and simple to operate.

These and other objects will be made manifest when considering the following detailed specification in combination with the appended drawings.

DESCRIPTION OF THE PREFERRED EMBODIMENT

Figure 1:
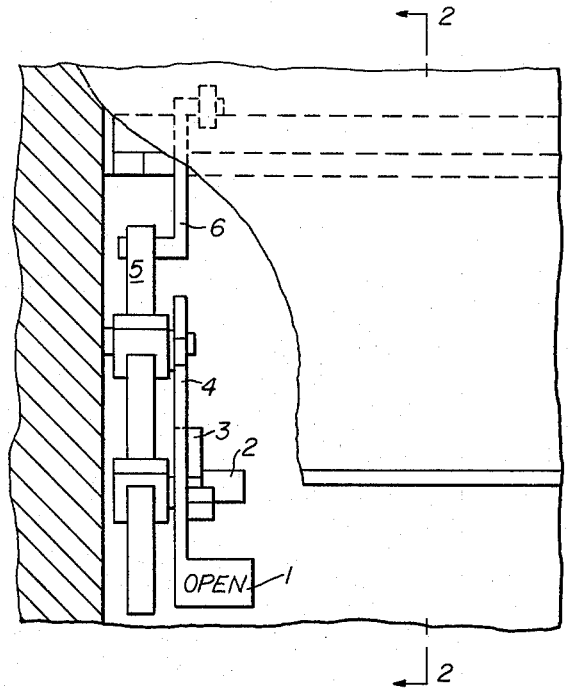
FIG. 1 shows a front plan view of the fireplace indicator mechanism in the open mode having a cut away portion removed from the lintel.

Referring to the drawngs now wherein like numerals refer to like parts throughout, reference numeral 10 generally denotes one embodiment or linkage according to the present invention and reference numeral 20 shows an alternative embodiment.

Figure 2:
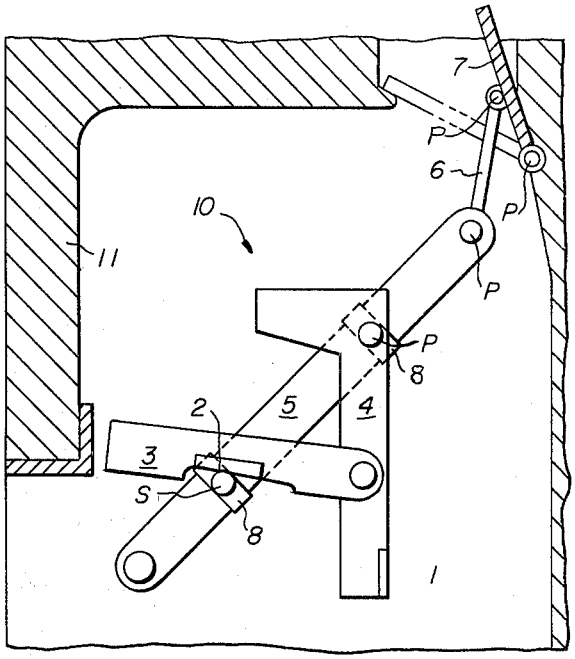
FIG. 2 is a side view of the view taken in FIG. 1 along lines 2—2 thereof.
Figure 3:
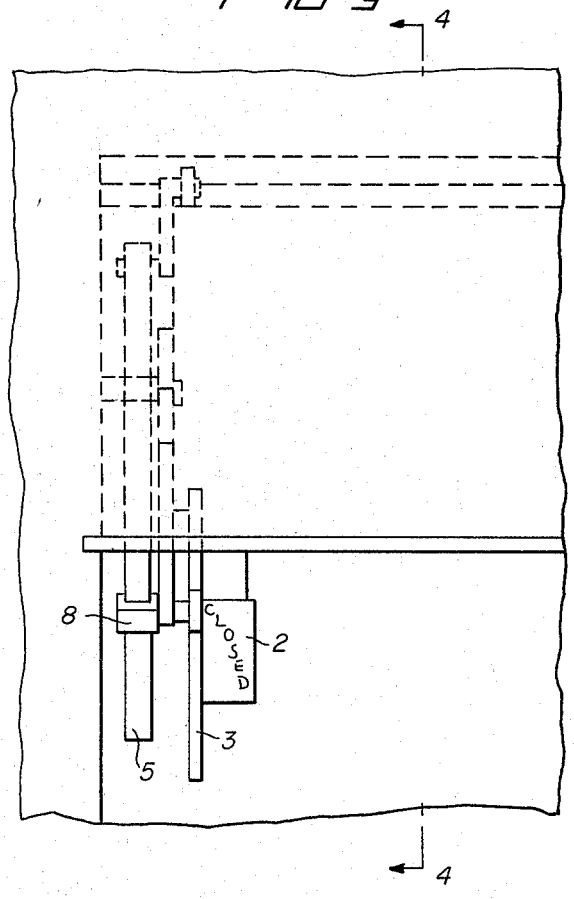
FIG. 3 is a front view similar to that of FIG. 1 showing the indicator in the closed mode.
Figure 4:
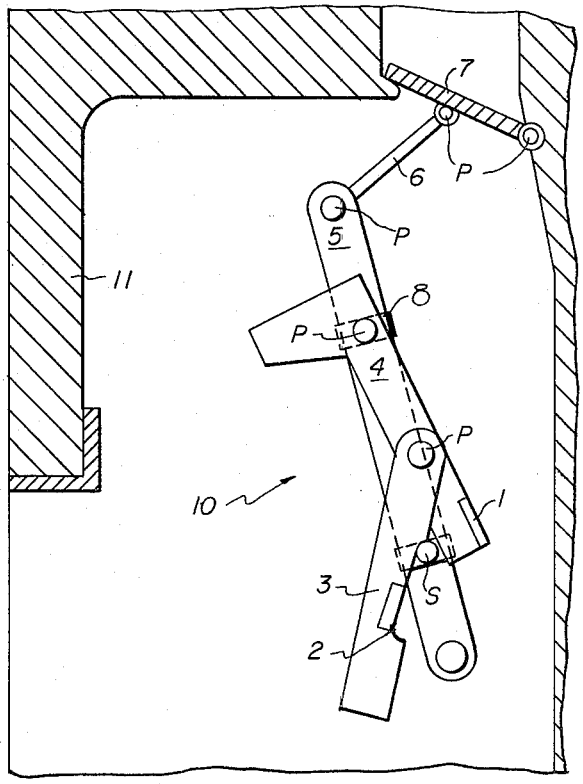
FIG. 4 is a side view taken along the lines 4—4 of FIG. 3.

Referring to FIGS. 1 through 4 at this time it will be noted that the linkage mechanism which actuates the damper door comprises a damper door 7 which is pivotally mounted to the exhaust of a fireplace, a link 6 pivotally connecting the damper door with damper arm 5. The notation P throughout these drawings denotes pivot points which are formed in conventional manner such as with rivets or the like. The damper arm 5 is connected to an inverted L-shaped indicator bar 4 at a point substantially one-third of its entire extent nearest to link 6. The L-shaped indicator bar is pivotally attached to damper arm 5 and extends vertically downwardly as best seen in FIG. 2 when the damper door is in the open mode. At the extremity of the bar 4 remote from the connection with the damper arm 5 an outstanding tab 1 is in view below the fireplace lintel indicating that the door is open. A second but linear indicator bar 3 is pivotally connected to the L-shaped indicator bar at a point approximately half way up the vertical leg of that bar 4, and a similarly outwardly extending indicator tab 2 is disposed thereon to indicate that the fireplace damper is in the closed mode when this lever is allowed to pivot about the point P that links 3 and 4 are connected by. For comparison purposes, the differences between FIGS. 2 and 4 should be noted. That is, when link 3 or indicator arm 3 is in the downward position it is caused to come in contact with a stopper element S disposed on damper arm 5 at its lower extremity. Stopper S is adjustably fixed to damper arm 5 via C clamp 8. When the damper arm is rotated in the position shown in FIG. 2, the damper door is open and indicator 1 reveals same. However when the second indicator link 3 is in the downward position it abuts against the S portion of C claim 8 and the damper arm 5 articulates such that the outstanding indicator tab 2 is rotated downward and easily viewed from an observer outside of the fireplace. In this closed position, stop member S is in tangential relation to both indicator arms 4 and 3 and provides a constraint whereby the lower portion of indicator arm 3 is constrained from displacement any further to the rear of the fireplace.

Figure 5:
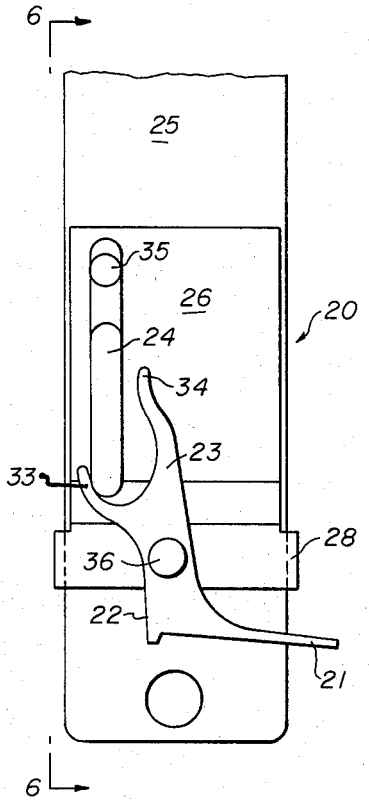
FIG. 5 is an alternative embodiment to a portion of the linkage shown in FIGS. 1 through 4.
Figure 6:
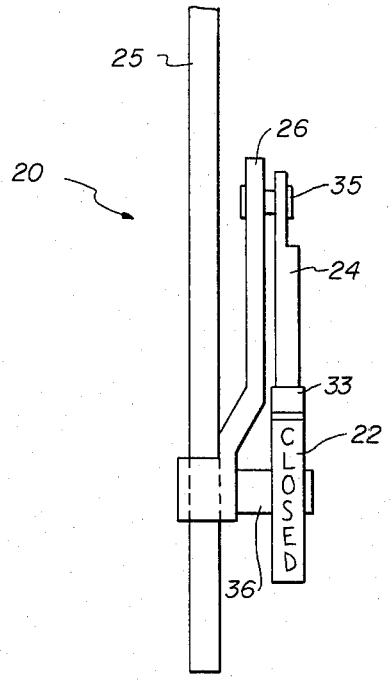
FIG. 6 is a side view taken along lines 6—6 of FIG. 5 in which the closed mode is indicated.
Figure 7:
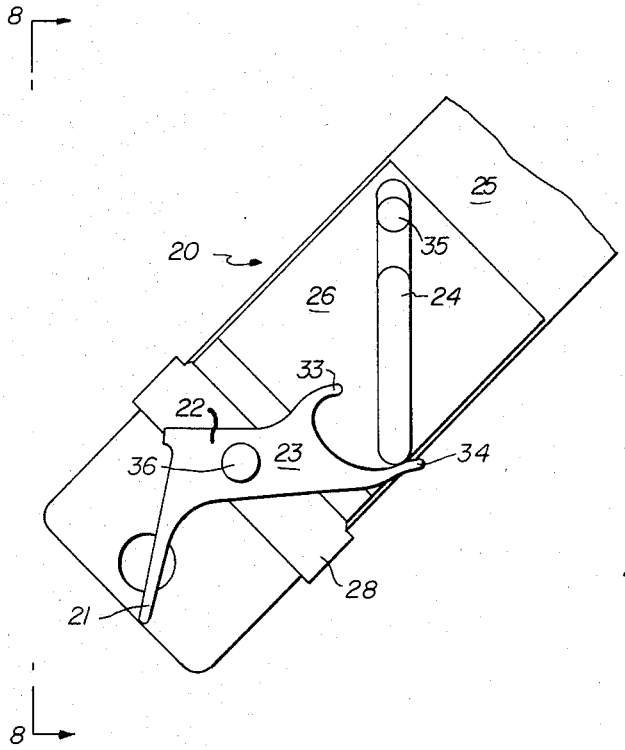
FIG. 7 shows the embodiments of FIG. 5 and 6 in the open mode.
Figure 8:
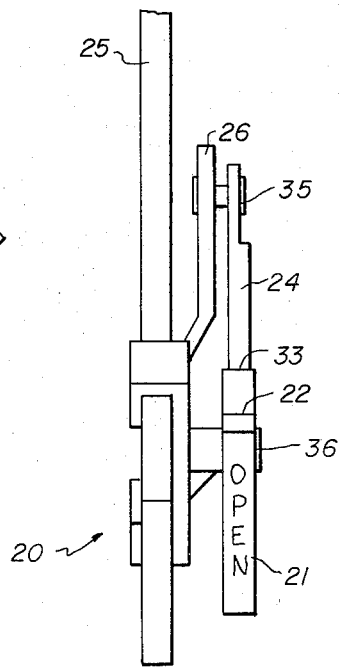
FIG. 8 shows another view of the mode of FIG. 7 taken along lines 8—8 of FIG. 7.

FIGS. 5 through 8 show an alternative linkage for indicating whether the damper is open or closed, and it is to be noted that element 25 of FIGS. 5 through 8 is intended to correspond substantially to the role that element 5 plays in FIGS. 1 through 4. That is to say, damper arm 5 in FIG. 1 through 4 and damper arm 25 in FIGS. 5 through 8 are both connected to connecting link 6 which in turn actuates the damper door 7. To understand this embodiment, it is important to note that link member 24 remains in a substantially vertical orientation throughout the entire motion of the linkage train, and that the rest of the links associated therewith move in relation thereto thereby providing an actuating effect on fork shaped member 23. FIGS. 5 and 6 show the condition in which the damper is closed and it will be seen that the vertical configuration of element 25 fairly closely parallels that of damper arm 5 in FIG. 4. The mechanism can be described as follows: the vertical arm 24 is pivotally attached to a C clamp 28 which rides upon damper arm 25. To this end, an upstanding tang portion 26 is connected to the C clamp 28 at one extremity and pivotally attached to the vertical link 24 through pivot pin 35. The C clamp 28 is provided with another pivot type pin 36 which extends outwardly and has disposed thereon a fork member 23 which provides the actuation desired. That is to say, the fork shaped member 23 has a lower tine 33 and upper tine 34 and the area between them defines a substantially U-shaped surface within which vertical element 24 is confined. At the area remote from these two tines 33,34 of the fork is a bottom face which has two surfaces angularly disposed relative to each other. In FIGS. 7 and 8 face 21 indicates that the door is in the open position and in that mode, the damper arm 25 is skewed relative to the vertical. When it is desired to have this door closed the arm 25 is rotated, and therefore a second face 22 is exposed which thereby provides the indication that the damper door is closed as seen in FIG. 6. Face 22 of the fork member indicates that the damper is indeed closed.

Vertical element 24 activates the fork member 23 in either direction and stops it, with its weight and its pendulum action, as shown in FIGS. 5 through 8. Element 24 is trapped inside the tines of member 23, and when element 24 stops swinging, member 23 is unable to turn further.

Having thus described the preferred embodiments of the invention it should be understood that numerous structural modifications and adaptations may be resorted to without departing from the spirit of the invention.

What is claimed is:

1. A fireplace damper door indicator assembly for revealing an open or closed position of a damper door comprising: a link pivotally connected to the door at one extremity of said link, a damper arm having one extremity pivotally connected to said link at said link's other extremity; and means connected to said damper arm provided with indicators whereby said indicators tell whether said damper door is open or closed wherein said means comprises a first indicator arm having a substantially inverted "L" shaped configuration pivotally connected to said damper arm at the point of intersection of two legs that form the "L" and an outstanding tab at a lowermost extremity of said first indicator arm indicating "open", and a second indicator arm pivotally connected to said first indicator arm forward thereof but which is prevented from overlying said first indicator arm by a stop member on said damper arm interposed between said first and second indicator arms and another outstanding tab on said second indicator arm indicating "closed" so that rotation of said damper arm selectively exposes one of said tabs.

2. A fireplace damper door indicator assembly for revealing an open or closed position of a damper door comprising: a link pivotally connected to the door at one extremity of said link, a damper arm having one extremity pivotally connected to said link at said link's other extremity; and means connected to said damper arm provided with indicators whereby said indicators tell whether said damper door is open or closed, wherein said means comprises a "C" clamp disposed on said damper arm having an upstanding tang for pivotal attachment to a vertical link at the upper extent of said tang, and a pivotal fork pivotally attached to said "C" clamp which fork has tines that straddle said vertical link said fork including firt and second faces which respectively indicate "open" and "closed" positions upon rotation of said fork.

* * * * *